US010443140B2

(12) United States Patent
Becasse et al.

(10) Patent No.: US 10,443,140 B2
(45) Date of Patent: Oct. 15, 2019

(54) ANODE ASSEMBLY

(71) Applicant: Rio Tinto Alcan International Limited, Montréal (CA)

(72) Inventors: Sébastien Becasse, Saint Pierre D'albigny (FR); Jean-François Bilodeau, Jonquière (CA); Denis Laroche, Jonquière (CA); Laurent Fiot, Hermillon (FR); Steve Langlois, Les Marches (FR)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 150 days.

(21) Appl. No.: 15/323,904

(22) PCT Filed: Jul. 1, 2015

(86) PCT No.: PCT/IB2015/001109
§ 371 (c)(1),
(2) Date: Jan. 4, 2017

(87) PCT Pub. No.: WO2016/001741
PCT Pub. Date: Jan. 7, 2016

(65) Prior Publication Data

US 2017/0167039 A1 Jun. 15, 2017

(30) Foreign Application Priority Data

Jul. 4, 2014 (FR) ..... 14 01517

(51) Int. Cl.
*C25C 3/12* (2006.01)
*C25C 3/16* (2006.01)
*C25C 3/08* (2006.01)

(52) U.S. Cl.
CPC ..... *C25C 3/12* (2013.01); *C25C 3/085* (2013.01); *C25C 3/16* (2013.01)

(58) Field of Classification Search
CPC .. C25C 3/06; C25C 3/08; C25C 3/085; C25C 3/12–3/125; C25C 3/16
See application file for complete search history.

(56) References Cited

U.S. PATENT DOCUMENTS 4,397,728 A 8/1983 Pfister et al.
4,612,105 A 9/1986 Langon
6,977,031 B1 * 12/2005 Jakovac ..... C25C 3/125 204/243.1
2010/0096258 A1 4/2010 Hiltmann et al.

FOREIGN PATENT DOCUMENTS

WO 2012/100340 A1 8/2012

OTHER PUBLICATIONS

Dictionary.com ("bead" definition, 2018). (Year: 2018).*
Oct. 14, 2015—International Search Report and Written Opinion of PCT/IB2015/001109.

* cited by examiner

*Primary Examiner* — Alexander W Keeling
(74) *Attorney, Agent, or Firm* — Banner & Witcoff, Ltd.

(57) ABSTRACT

Anode assembly (100) comprising an anode (3) and an anode support (4) for the production of aluminum, characterized in that the anode assembly (100) comprises an electrical connecting element (1) to electrically connect the anode support (4) with the anode (3), and at least one thermally insulating element (6) arranged to reduce heat transfer between the anode (3) and the anode support (4) during the production of aluminum.

20 Claims, 2 Drawing Sheets

ANODE ASSEMBLY

CROSS-REFERENCE TO RELATED APPLICATIONS

This application is a U.S. National Stage application under 35 U.S.C. § 371 of International Application PCT/IB2015/001109 (published as WO 2016/001741 A1), filed Jul. 1, 2015, which claims priority to French Patent Application No. 1401517, filed Jul. 4, 2014, and the present application claims priority to and the benefit of both of these prior applications, each of which is incorporated by reference in its entirety.

TECHNICAL FIELD

The present invention relates to an anode assembly comprising an anode support and an anode for the production of aluminum.

BACKGROUND

Aluminum is conventionally produced in aluminum smelters by electrolysis using the Hall-Héroult process. To this end, an electrolytic cell is provided comprising a pot shell and a lining of refractory material. The electrolytic cell also comprises cathode blocks arranged at the bottom of the pot shell, covered by conductive bars designed to collect the electrolysis current in order to route it to the next electrolytic cell. The electrolytic cell also comprises at least one anode block suspended from an anode support, such as a cross-piece and partially immersed in an electrolytic bath, above the cathode blocks. A layer of liquid aluminum, covering the cathode blocks, is formed as the reaction proceeds. Current flow takes place from the anode support to the cathode via the anode block and the electrolytic bath at a temperature of about 970° C. in which the alumina is dissolved. This electrolysis current can reach several hundreds of thousands of amperes. The anode block is then suspended by an intermediate member, capable of carrying the high current, of withstanding these very high temperatures and of supporting the weight of the anode, such as a stub made of steel.

In such a device, a very large heat flow is formed between the carbon anode and the anode support. This heat transfer is the source of major and detrimental energy loss in the electrolysis process.

It was observed that locally reducing the cross section of the stub made it possible to obtain a significant temperature drop: from 650° C. to 320° C. for a reduction in section over a stub length of about 10 cm. In the solid section of the stub, the extraction of heat to the anode support is primarily through conduction, and reducing the cross section of the stub greatly limits heat transfer by conduction. In this configuration, the stub may be formed of two portions having different cross-sections which can be machined or formed from separate welded elements to reduce the thermal energy loss by conduction. However, this section reduction reduces electrical conductance and therefore increases power consumption. Moreover, this solution has a significant financial cost because it requires at least a portion to be machined from an available stub in the general shape of a standard cylinder. This machining step is also time-consuming and contributes to a substantial loss of material.

It is known from patent publication U.S. Pat. No. 6,977,031 to place a thermally insulating disc between the bottom wall of the stub and the bottom of a sleeve serving to fix the stub into a recess in the anode. This thermally insulating disk arranged in the bottom of the recess allows better control of the heat flow path, which must, in the arrangement of U.S. Pat. No. 6,977,031, pass through the sides of the recess, the vertical walls of the sleeve and then the stub in order to improve the removal of heat from the anode to the anode support. The result obtained with the arrangement of U.S. Pat. No. 6,977,031 is therefore opposite to that intended, i.e. to reduce heat loss from the anode to the anode support.

BRIEF SUMMARY

The invention therefore aims to propose a device to limit heat losses without affecting its electrical conductance while minimizing costs. To do this, the invention provides an anode assembly for the production of aluminum comprising an anode, an anode support, and an electrical connecting element having a sealing portion and a non-sealing portion for electrically connecting the anode support to the anode, wherein the anode comprises a recess in which is housed the sealing portion of the electrical connecting element and wherein a seal formed of an electrically conductive material holds the electrical connecting element, the anode assembly comprising at least one thermally insulating element arranged between two walls facing each other belonging to the non-sealing portion of the electrical connection element and/or the anode support to reduce heat transfer between the anode and the anode support during the production of aluminum.

In this way, heat losses by radiation between the surfaces between which the thermally insulating element is interposed are prevented, which reduces the heat losses of the anode assembly while maintaining a satisfactory electrical connection between the anode support and the anode.

Sealing ensures an electrical conductivity function while allowing mechanical attachment between the electrical connecting element and the anode. Sealing typically extends along the side wall of the sealing portion of the electrical connecting element. This lateral contact between the seal and the electrical connecting element makes for very good electrical conductivity, and also very good thermal conductivity between the anode and the electrical connecting element.

Preferably, the two walls facing each other are electrically and mechanically connected by means of a bead of electrically conductive material, more particularly a weld bead. In this way, the bead of electrically conductive material provides mechanical strength and electrical conductivity in the area where the two walls are separated by a thermally insulating element.

In an advantageous arrangement, the electrical connecting element extends in a direction of extension between the anode and the anode support and at least one thermally insulating element extends in a plane transverse to the direction of extension. In this configuration, the heat transfer along the transverse section of the electrical connecting element is significantly decreased because heat losses by radiation between the surfaces between which the heat insulating element is interposed are prevented.

According to a preferred possibility, at least one thermally insulating element is arranged between a wall of the electrical connecting element and a wall of the anode support. This configuration with a thermally insulating member interposed between the electrical connecting element and the anode support is particularly advantageous in that heat flows by radiation and conduction between the electrical connecting element and the anode support are limited. The presence of thermal insulation at this interface is therefore very easy to use and very effective to limit energy losses.

Preferably, the anode assembly comprises a bead of electrically conductive material, more particularly a weld bead, arranged to electrically and mechanically connect the electrical connecting element and the anode support. In this way, the electrical connection element provides mechanical support for the anode while promoting electrical conductivity between the anode support and the anode.

It was observed by the applicant that the electrical current flowing between two parts welded together, the walls of which face each other and are in contact, passes almost entirely through the welds. Positioning a heat-insulating element between these walls facing each other allows heat gain and does not have any impact on the electrical conductivity of the anode assembly.

According to one variant, the non-sealing portion of the electrical connection element defines a housing in which at least one thermally insulating element is arranged. The thermally insulating element inhibits heat transfer by radiation between opposite walls of the housing.

Typically, the housing is formed by a notch in the electrical connection element. This notch can in particular be machined in the electrical connection element.

Preferably, the notch opens out laterally from the non-sealing portion of the electrical connection element so that the heat insulating element is easily inserted into the electrical connection element. This variant is therefore very simple to implement.

According to one possibility, the non-sealing portion of the electrical connection element comprises a first portion and a second portion, the first and second portions being separated by at least one thermally insulating element. In this way, conductive heat transfer is limited to the cross section of the non-sealing portion of the electrical connection element between the first and second portions.

Preferably, an additional bead of electrically conductive material, in particular a weld bead, is arranged to cover at least part of said at least one thermally insulating element and to electrically and mechanically connect the first portion and the second portion. The mechanical strength and electrical conductivity between the anode support and the anode therefore remains very satisfactory for a significant reduction in heat transfer. The heat insulating element is further protected by being confined in the housing.

Advantageously, the anode assembly further comprises a heat insulating element arranged at the interface between the electrical connection element and the anode support. In this way, reduction of heat transfer is further improved.

In one variant, the first portion arranged adjacent to the anode support has a smaller cross section than that of the second portion arranged near the anode and an electrical conductivity component is arranged to electrically connect the second portion and the anode support. In this configuration, the reduction of area of the first portion reducing heat transfer has no impact on electrical conductivity by virtue of the presence of the electrical conductivity component.

Typically, the electrical connection element comprises a substantially cylindrical shape, such as a steel stub. The steel makes it possible to withstand the corrosive environment in the electrolytic cell at very high temperatures and is of sufficient strength to support the anode.

According to one possibility, at least one thermally insulating element comprises a plate shape, formed, in particular, from a sintered powder, a film or a fiber mat including at least one refractory material. This sintered powder has the advantage of being easily shaped and is suitable to be arranged in any geometric configuration of the anode assembly.

Other aspects, objects and advantages of the invention will appear more clearly on reading the following description of embodiments thereof, given as non-limiting examples and with reference to the accompanying drawings. The figures are not necessarily to scale for all the elements shown in order to improve readability. In the following description, for simplicity, elements that are identical, similar or equivalent to the various embodiments have the same reference numbers.

DETAILED DESCRIPTION

Figure 1:
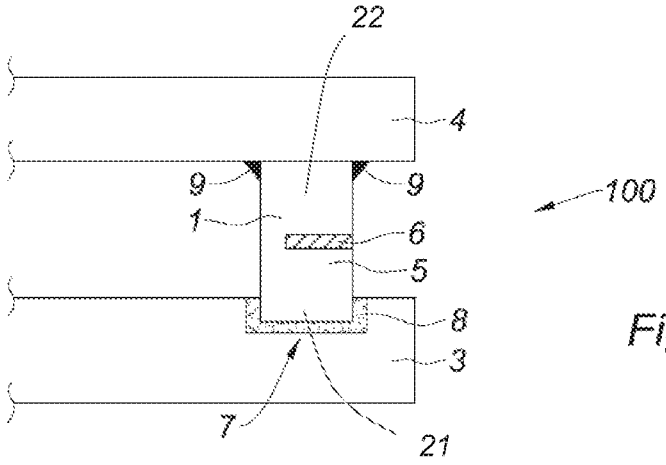
FIG. 1 shows an anode assembly according to a first embodiment of the invention.

As illustrated in FIG. 1, the anode assembly 100 includes an anode 3, typically made of carbon, and an anode support 4 for the production of aluminum by electrolysis according to the Hall-Héroult process. Anode 3 is suspended from the anode support 4 by an electrical connecting element 1 having a sealing portion 21 for fixing to anode 3 and providing electrical conductivity to anode 3, and a non-sealing portion 22 which provides the mechanical suspension of anode 3.

Anode 3 comprises in its upper part a recess 7 in which the sealing portion 21 of the electric connecting element 1 is housed and fixed by a seal 8 made of an electrically conductive material, for example cast iron. The sealing portion 21 is therefore the lower part of the electrical connecting element 1 which is caught in the seal 8, in contrast to the non-sealing portion 22 which extends above the seal 8. It is understood in the present document that any other material suitable for the seal 8 can be used, including adhesive carbonaceous paste. This seal 8 covers all the surfaces of the recess 7 and the sealing portion 21 of the electrical connecting element 1 housed in recess 7. Seal 8 may alternatively extend along the side walls of the sealing portion 21 and not on the underside.

The anode assembly also comprises a bead 9 of electrically conductive material, arranged to provide electrical and mechanical connection between the anode support 4 and the electrical connecting element 1, especially in the upper part of the non-sealing portion 22 of electrical connecting element 1. Electrical connecting element 1 is typically made of steel and has the shape of a cylinder. Bead 9 can be formed by a weld based on cupro-type copper, arranged laterally at the interface between the electrical connecting element 1 and the anode support 4.

FIG. 1 also illustrates, in the non-sealing portion 22, a thermally insulating element 6 which extends in a plane transverse to the direction of extension of the electrical connecting element 1 between the anode 3 and the anode support 4. This configuration effectively reduces heat transfer from the anode 3 to the anode support 4. More precisely, the electrical connecting element 1 comprises a housing 5, formed from a notch opening out laterally, in which a thermally insulating element 6 is arranged. This thermally insulating element 6 may be made of any suitable refractory materials, such as sintered powder, a film or a fiber mat, including at least one refractory material.

Figure 2:
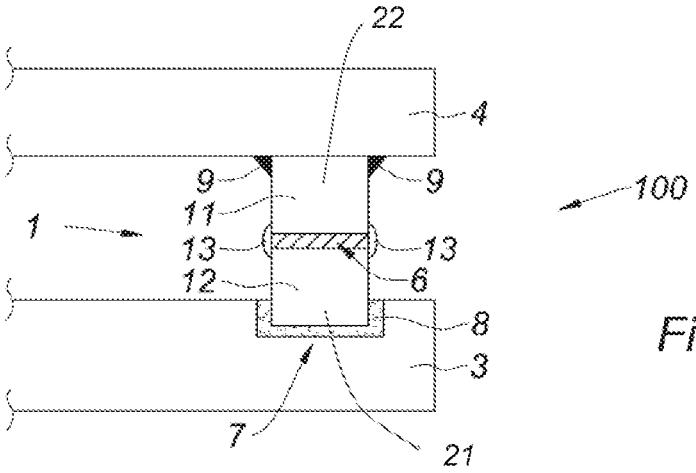
FIG. 2 shows an anode assembly according to an alternative embodiment of the invention.

In the embodiment illustrated in FIG. 2, non-sealing portion 22 of the electrical connecting element 1 comprises a first portion 11 and a second portion 12 separate from the first portion 11 between which a thermally insulating element 6 is arranged. Conduction heat transfer is significantly decreased by the fact that the entire cross section of electrical connecting element 1 is covered by the thermally insulating element 6. Electrical conductivity is then provided by an additional bead 13 of an electrically conductive material arranged laterally in relation to thermally insulating element 6 so as to electrically and mechanically connect the first portion 11 and the second portion 12.

Figure 3:
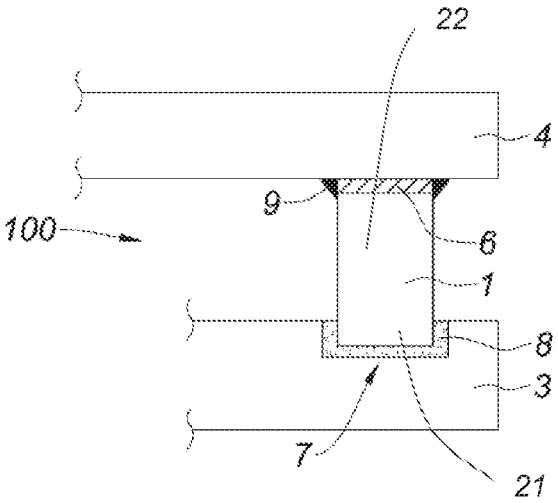
FIG. 3 shows an anode assembly according to a second embodiment of the invention.

The embodiment shown in FIG. 3 differs from the two previous embodiments particularly in that the thermally insulating element 6 is arranged at the interface between the electrical connecting element 1 and the anode support 4. As with the embodiment illustrated in FIG. 1, bead 9 is arranged laterally in relation to insulating element 6 so as to ensure electrical and mechanical connection between electrical connecting element 1 and anode support 4. It was observed that electrical conductivity between the anode and the anode support mainly occurred via the weld bead 9 and not by the opposite surfaces being brought into contact so that a thermally insulating element may advantageously be inserted between the electrical connecting element and the anode support without detriment to overall electrical conductivity. Heat loss by radiation can be limited between the electrical connecting element and the anode support.

Figure 4:
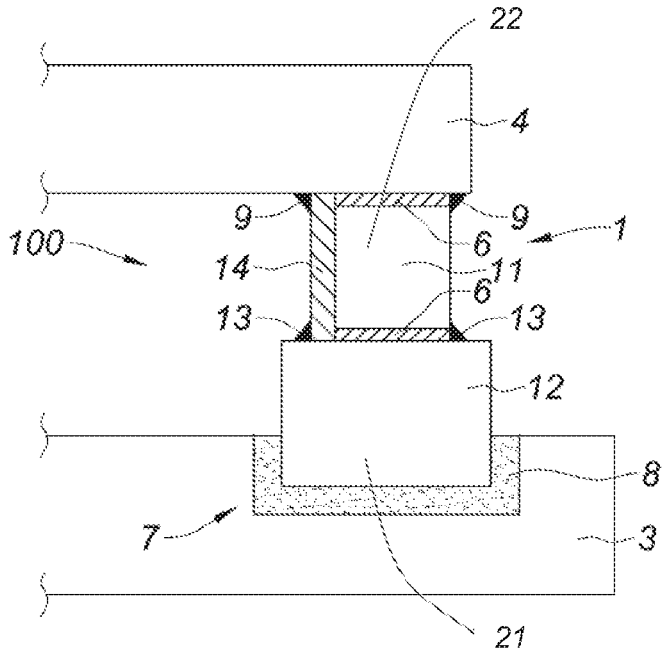
FIG. 4 shows an anode assembly according to yet another embodiment of the invention.

According to the embodiment illustrated in FIG. 4, the non-sealing portion 22 of electrical connecting element 1 comprises a first portion 11 arranged on the side of anode support 4 and a second portion 12 arranged on the side of anode 3. The cross section of the first portion 11 is smaller in relation to that of the second portion 12 so as to limit heat transfer. Furthermore, the anode assembly comprises a thermally insulating member 6 arranged between electrical connecting element 1 and anode support 4 and further includes a thermally insulating member 6 arranged between the first portion 11 and second portion 12. An electrical conductivity component 14, such as a copper plate, is arranged to provide an electrical connection between the second portion 12 and the anode support 4 and rests against a part of the first portion 11. In this configuration, heat transfer is very much limited by the presence of two thermally insulating elements 6 and the smaller cross section of the first portion 11. Furthermore, electrical connection is provided by bead 9 and additional bead 13 as well as the highly conductive copper plate. As the section of the copper plate is small, thermal conductivity through it is very limited.

So the present invention proposes an anode assembly 100 making it possible to effectively reduce heat loss between anode 3 and the anode support 4 by reducing heat transfer while also maintaining a very good electrical conductivity.

It goes without saying that the invention is not limited to the embodiments described above by way of example, but includes all technical equivalents and variants of the means described and combinations of these.

The invention claimed is:

1. Anode assembly for production of aluminum comprising an anode, an anode support, and an electrical connecting element having a sealing portion and a non-sealing portion for electrically connecting the anode support to the anode, wherein the anode comprises a recess in which is located the sealing portion of the electrical connecting element and wherein a seal formed of an electrically conductive material holds the electrical connecting element, characterized in that at least one thermally insulating element is arranged between two walls facing each other belonging to the non-sealing portion of the electrical connecting element and/or to the anode support to reduce heat transfer between the anode and the anode support during the production of aluminum, and wherein the at least one thermally insulating element is located outside the recess of the anode.

2. Anode assembly according to claim 1, wherein the two walls facing each other are electrically and mechanically connected by means of a bead of electrically conductive material.

3. Anode assembly according to claim 1, wherein the electrical connecting element extends in a direction of extension between the anode and the anode support and wherein the at least one thermally insulating element extends in a plane transverse to the direction of extension.

4. Anode assembly according to claim 1, wherein the at least one thermally insulating element is arranged between one wall of the electrical connecting element and one wall of the anode support.

5. Anode assembly according to claim 1, wherein the anode assembly further comprises a bead of electrically conductive material arranged to electrically and mechanically connect the electrical connecting element and the anode support.

6. Anode assembly according to claim 1, wherein the non-sealing portion of the electrical connecting element defines a housing wherein the at least one thermally insulating element is arranged.

7. Anode assembly according to claim 6, wherein the housing is formed by a notch in the non-sealing portion of the electrical connecting element.

8. Anode assembly according to claim 7, wherein the notch opens out laterally from the non-sealing portion of the electrical connecting element.

9. Anode assembly according to claim 1, wherein the non-sealing portion of the electrical connecting element comprises a first portion and a second portion, the first and second portions being separated by the at least one thermally insulating element.

10. Anode assembly according to claim 9, wherein a bead of electrically conductive material is arranged to cover at least a portion of said at least one thermally insulating element and to electrically and mechanically connect the first portion and the second portion.

11. Anode assembly according to claim 9, wherein the first portion is arranged on a side of the anode support and has a smaller cross section reduced relative to that of the second portion, the second portion being arranged on the side of the anode, and wherein an electrical conductivity component is arranged to electrically connect the second portion and the anode support.

12. Anode assembly according to claim 1, wherein the electrically conductive material comprises a substantially cylindrical shape.

13. Anode assembly according to claim 1, wherein the at least one thermally insulating element comprises a plate shape, formed from a sintered powder, a film or a fiber mat including at least one refractory material.

14. Anode assembly according to claim 1, wherein the at least one thermally insulating element is positioned above a top surface of the anode.

15. Anode assembly according to claim 1, wherein the at least one thermally insulating element is positioned above the seal.

16. Anode assembly for production of aluminum comprising:

an anode comprising a recess;

an anode support; and an electrical connecting element having a sealing portion located in the recess of the anode and a non-sealing portion located outside the recess of the anode, for electrically connecting the anode support to the anode, wherein a seal formed of an electrically conductive material holds the electrical connecting element, characterized in that at least one thermally insulating element is arranged between first and second walls facing each other, wherein the first wall belongs to the non-sealing portion of the electrical connecting element, and the second wall belongs to the non-sealing portion of the electrical connecting element or the anode support, to reduce heat transfer between the anode and the anode support during the production of aluminum, and wherein the at least one thermally insulating element is located outside the recess of the anode.

17. Anode assembly according to claim 16, wherein the at least one thermally insulating element is positioned above a top surface of the anode.

18. Anode assembly according to claim 16, wherein the at least one thermally insulating element is positioned above the seal.

19. Anode assembly for production of aluminum comprising an anode, an anode support, and an electrical connecting element having a sealing portion and a non-sealing portion for electrically connecting the anode support to the anode, wherein the anode comprises a recess in which is located the sealing portion of the electrical connecting element and wherein a seal formed of an electrically conductive material holds the electrical connecting element, characterized in that at least one thermally insulating element is arranged between two walls facing each other belonging to the non-sealing portion of the electrical connecting element and/or to the anode support to reduce heat transfer between the anode and the anode support during the production of aluminum, wherein the non-sealing portion of the electrical connecting element defines a housing wherein the at least one thermally insulating element is arranged, and wherein the housing is formed by a notch in the non-sealing portion of the electrical connecting element.

20. Anode assembly according to claim 19, wherein the notch opens out laterally from the non-sealing portion of the electrical connecting element.

* * * * *